United States Patent [19]

Chadwick et al.

[11] 4,412,580

[45] Nov. 1, 1983

[54] COOLING APPARATUS FOR WHEEL-BAND CONTINUOUS CASTING MACHINES

[75] Inventors: Kenneth E. Chadwick; E. Henry Chia; Robert H. Ogletree; Frank M. Powers, all of Carrollton; Larry S. Richardson, Bowdon, all of Ga.

[73] Assignee: Southwire Company

[21] Appl. No.: 210,655

[22] Filed: Nov. 26, 1980

[51] Int. Cl.[3] ..... B22D 11/06; B22D 11/00

[52] U.S. Cl. ..... 164/433; 164/443; 164/482

[58] Field of Search ..... 164/431, 432, 433, 443, 164/481, 482, 485

[56] References Cited

U.S. PATENT DOCUMENTS 3,474,853 10/1969 Hazelett et al. ..... 164/433
3,533,463 10/1970 Hazelett ..... 164/433
3,596,702 8/1971 Ward ..... 164/485 X
4,054,171 10/1977 Stone ..... 164/482

FOREIGN PATENT DOCUMENTS 251781 12/1977 U.S.S.R. ..... 164/443

*Primary Examiner*—Nicholas P. Godici
*Assistant Examiner*—Jerold L. Johnson
*Attorney, Agent, or Firm*—Herbert M. Hanegan; Stanley L. Tate; Robert S. Linne

[57] ABSTRACT

Disclosed is an apparatus for and a method for more uniform and rapid cooling of molten metal, which is continuously cast into a wheel-band machine, by dispersing a relatively small amount of coolant from the periphery of a band presser wheel onto the continuous metal band at the point where the molten metal first contacts said band, with the unexpected beneficial effects of increasing the cast bar temperature and greatly reducing the amount of inverse segregation on the band-side surface of the resulting cast bar.

5 Claims, 4 Drawing Figures

COOLING APPARATUS FOR WHEEL-BAND CONTINUOUS CASTING MACHINES

BACKGROUND OF THE INVENTION

The invention disclosed herein relates generally to the continuous casting of metals and, in particular, to an apparatus for and a method of uniformly cooling a solidifying metal bar, such as an aluminum or steel alloy, as it is cast by an improved wheel-and-band type continuous casting machine.

Although recent advances in the art of cooling continuously cast metal bar are a significant improvement over previous cooling methods first utilized in the 1960's, such methods still do not achieve complete uniformity of cooling during the entire solidification process. Thus the major problem of inverse segregation, especially on the top or band-side surface of a cast alloy bar, still occurs and adversely affects the subsequent working characteristics of the bar.

A desirable property of almost any metal alloy, preferably in its as-cast condition, is a uniform distribution within the cast product of the constituents and impurities normally found in the alloy. As used herein, what applicants believe to be the meaning of these terms is their standard meanings in the art, that is, "constituents" means ingredients or elements which make up a metallurgical system or a phase or combination of phases which occur in a characteristic configuration in an alloy microstructure, while "impurities" means elements or compounds whose presence in any material is generally undesired. Constituents, as used herein, then, would include the materials combined into a metallurgical system to produce the particular type of alloy being cast but would not include the impurities, or undesired elements or compounds present in the cast metal. For example, Aluminum Alloys such as 6201 (Al. Assoc. Designation) or ALDREY and ALMELEC (European designations) contain about 0.5% to 0.9% silicon, 0.5% iron, and 0.6% to 0.9% magnesium plus minor amounts of other elements such as copper, manganese, zinc, etc. In any case, segregation of the components in the cast alloy makes it less suitable for subsequent processing such as forging or rolling into rod and then drawing into wire. As used herein, the term "segregation" also has what applicants believe to be its normal meaning in the art, that is, segregation is a term used to describe the nonuniform distribution or concentration of constituents (or impurities) which arises during the solidification of a metal. For example, a concentration or accumulation of impurities in various positions within a metal is referred to in the art as segregation.

In normal segregation, for example in steel alloys, the constituents (solute) in the iron (solvent) rejected from the freezing liquid accumulate at the advancing solid/-liquid interface so that the constituents of lowest melting point concentrate in the last portions to solidify, but in inverse segregation, for example in aluminum alloys, this is reversed, for the liquid with high solute concentration becomes trapped in between the dendrites, thereby causing a decrease in concentration of solutes from the ingot surface toward the center. Inverse segregation, then, is a concentration of constituents or impurities to a higher degree near the outer surfaces (as compared to the interior) of an ingot or casting.

Prior art methods of continuously casting alloys have often provided cast products having a relatively high degree of segregation of impurities and alloying materials within, or on the surface of, the cast bar. Because of the high level of constituents and impurities in many aluminum alloys, inverse segregation usually occurs. Such uneven distribution of impurities and/or constituents within the cast bar makes it desirable that the total amount of same within the alloy be reduced, thus also reducing the peak concentrations, so that subsequent processing of the cast bar does not result in unacceptable internal or surface characteristics in the product manufactured from the cast bar. A reduction in the total amount of impurities, however, usually requires expensive additional refining of the alloy prior to casting and is sometimes commercially unfeasible or impractical altogether while sometimes the addition of particular constituents (i.e. alloying elements) is desirable or necessary. It is apparent then, that the solidification process should be somehow controlled so as to eliminate segregation before it occurs. Howver this is especially difficult in a continuous casting process of the wheel & band type wherein the moving mold is subject to a complex and stationary cooling system fitted into the small space around the mold.

PRIOR ART

One type of prior art cooling apparatus and method is disclosed in U.S. Pat. Nos. 3,279,000 and 3,333,624 and employs nozzles to spray coolant onto the rotating mold. The coolant flow is controlled by a single main valve to achieve a predetermined temperature of the cast metal bar exiting the casting machine. This method does not achieve uniform solidification because it lacks accurate control of coolant flow from the individual nozzles and it monitors only the exit temperature of the cast bar. Neither does this method reduce the incidence of inverse segregation since the cooling of the band is not effected until later when the metal has already reached a partially solid state.

Another type of prior art cooling apparatus and method, disclosed in U.S. Pat. No. 3,346,038, uses independently adjustable nozzles in corresponding inner- and band-side manifolds to direct coolant onto two sides of the casting machine mold. Although this system recognizes the need for individualized control, it fails to achieve uniform solidification because it allows the molten metal to cool upon first contact with the wheel or band, then remelt because of contact with the hotter incoming molten metal that surrounds it, often creating inverse segregation on the surface of the cast bar.

Other prior patents which describe and illustrate some of the complexities and problems in cooling a continuously cast alloy bar are: U.S. Pat. Nos. 3,329,197, 3,333,629, 3,315,126, 3,429,363, 3,596,702, 3,626,479, 3,650,316, and 3,766,967 and the patents cited therein.

Finished products, such as wire and cable, produced from steel or aluminum alloys cast with prior art cooling methods often have substantial amounts of inverse segregation on the surface and thus have lower electrical conductivity, strength and ductility qualities than those produced from alloys cast by the present invention which has little or no inverse segregation.

SUMMARY OF THE INVENTION

It is an object of this invention to provide an apparatus & method for evenly dispersing a small amount of coolant on to one side of the casting wheel band at nearly the same position that the molten metal contacts the other side of the band, with said dispersion having the favorable effect of increasing the cast bar exit temperature and reducing the incidence of inverse segregation that is normally encountered when casting certain metal alloys.

The above object of the invention is achieved by a continuous casting machine generally of the wheel-and-belt type, but wherein the first band guide wheel or presser wheel has an outer peripheral surface that is interspersed with periodic rows of circular ports or holes, through which a cooling medium may flow onto the casting-wheel band. The rows of ports are sealed from the inside of the wheel, in a manner that prevents substantial leakage of the cooling medium, by the presence of a plurality of blocks made of a resilient material, such as rubber or neoprene. The sealing blocks, which are normally held closed by a spring mechanism, are forced upward at the appropriate time by a series of rollers mounted on a fixed arm that originates at the hub of the presser wheel. Said rollers force the sealing blocks upward allowing the coolant to exude from the aforementioned ports in the presser wheel onto the casting-wheel band. The sealing blocks are forced down by the spring mechanism after the wheel has rotated past the point that the rollers are encountered, with result of again sealing the ports in the pressure wheel and stopping the flow of coolant.

The cooling medium, such as water, is contained within the interior of the presser wheel. Said coolant is transferred from the main coolant supply to the wheel through a hollow stationary shaft. The presser wheel turns on bearings around the shaft and a water tight seal may be provided between the stationary shaft and wheel to prevent the coolant from escaping or reaching the bearings. Alternately, a float valve may be positioned within the wheel to prevent the coolant level from reaching the shaft bearings.

By providing a cooling media to the band near the point where the molten metal is poured into the wheel, solidification will begin at the place of first contact between the molten metal and the now chilled band, since it has been cooled directly by the coolant sprayed from the presser wheel. Immediately after solidification starts to occur at this initial point of contact, the solid grains nucleating from the molten liquid will grow continuously into the molten metal pool thereby providing a stable layer which will remain solid as the rest of the metal solidifies completely, thus avoiding remelting of the surface layers and the possibility of creating inverse segregation thereon.

The present invention provides an efficient means of producing stable nuclei in the mold walls which will result in a ever increasing solid crust that will remain stable, without remelting, until the normal high volume of cooling media is applied later in the casting wheel proper.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanying drawings in which like parts are given like numerals and wherein:

FIG. 3 is a partial cross sectional view taken along the vertical line A—A of FIG. 2; while

DETAILED DESCRIPTION OF THE PREFERRED EMBODIMENT

Figure 1:
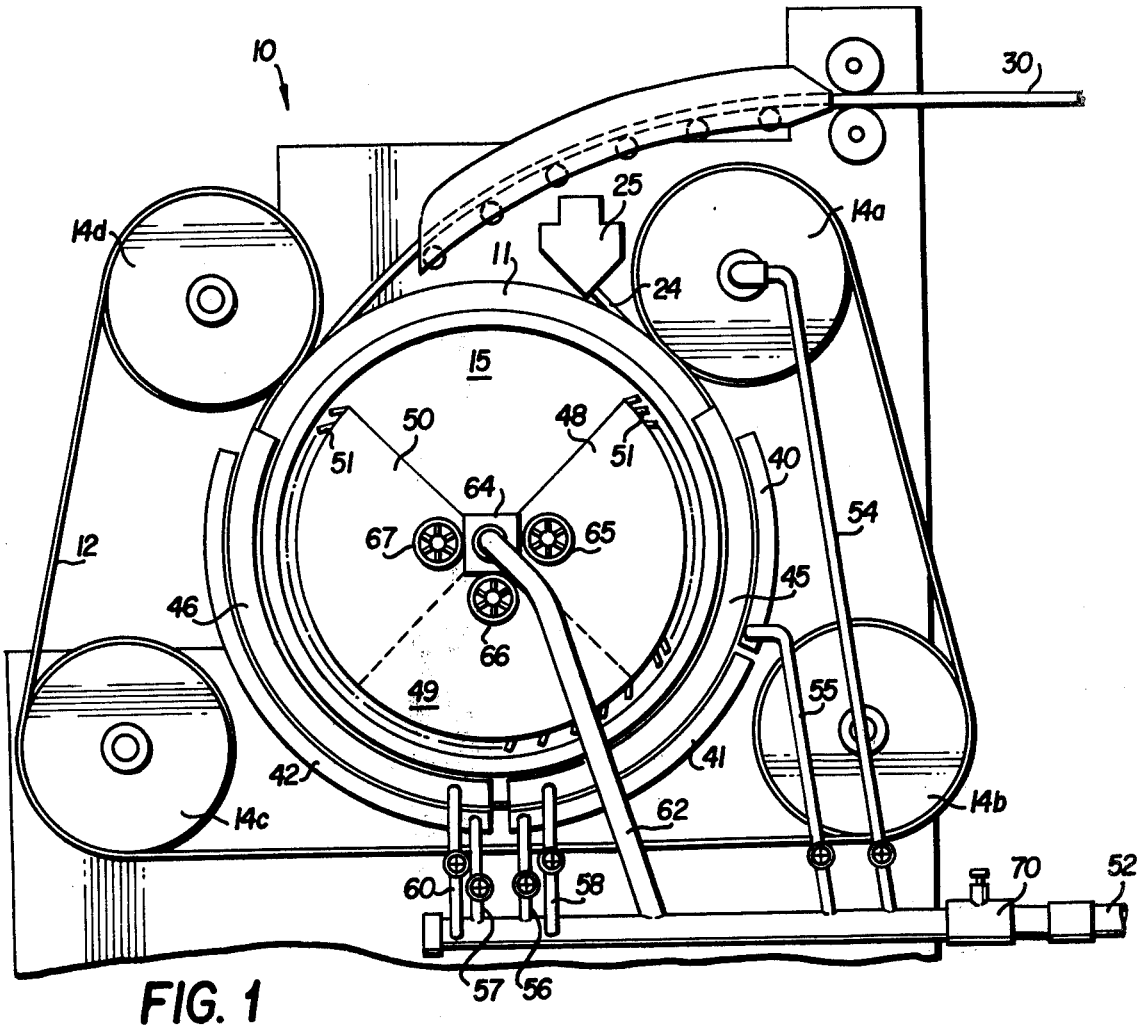
FIG. 1 shows a side elevation of a typical continuous casting machine incorporating a presser wheel embodying the present invention.

Referring now in more detail to the drawings, in which like numerals indicate like parts throughout the several views, FIG. 1 shows one type of machine 10 for the continuous casting of metal with some parts eliminated for clarity and generally well known in the art. Casting machine 10 includes a rotatable casting wheel 11, an endless flexible metalic band 12, and band positioning rollers **14*a*, 14*b*, 14*c*, 14*d* which position and guide the band 12 about a portion of the casting wheel 11**.

The casting wheel 11 is removably affixed to rotatable support plate 15 which in turn is adapted to be driven by a variable-speed motor (not shown) so as to rotate the assembly in a clockwise direction. The casting wheel 11 has an outwardly facing annular peripheral groove which is closed by band 12 to form an arcuate mold cavity which extends about the lower portion of casting wheel 11.

The first band positioning roller **14*a*, which is hereinafter called the presser wheel, functions to position the band 12 against the casting wheel 11** so as to tightly seal this portion of the peripheral groove which is to receive the molten metal.

The last band positioning roller **14*d*, which is hereinafter called the tension wheel, is movable in a vertical direction and functions to tension band 12 against the lower portion of the casting wheel 11**.

There are usually two or more other band positioning rollers **14*b* and 14*c* which are often called idler wheels and which function merely to guide the band 12 along its path from the tension wheel 14*d* back to the presser wheel 14*a***.

During use, the band 12 frictionally engages the casting wheel 11 so that as casting wheel is rotated by its support plate 15, the band 12 is urged along its path at the same speed. Thus a moving mold cavity is formed within the lower portion of the casting wheel.

Molten metal is supplied to the moving mold cavity from a furnace (not shown) through a pouring pot 25 and pouring spout 24. The rate of flow of moten metal from the pouring spout 24 is regulated by suitable means so that the level of the molten metal pool remains just below the point at which the presser wheel **14*a* seals the band 12 against the peripheral groove in the casting wheel 11**.

As casting wheel 11 is rotated, the molten metal is carried along its arcuate path within the moving mold where it is solidified by the cooling system and subsequently extracted as a cast bar for further processing.

The cooling system comprises a multitude of liquid spraying nozzles 51 which direct a coolant, such as water, against the surfaces of the casting wheel 11 and the band 12 so as to extract heat therefrom thus also extracting heat from the metal within the moving mold.

Some of the spray nozzles 51 communicate with casting wheel internal manifolds 48, 49, 50 while others communicate with band manifolds 40, 41, 42 and still others communicate with pairs of wheel side manifolds 45, 46.

Casting wheel manifolds 48, 49, 50 are positioned adjacent the rotatable support plate 15 and generally in the same plane as casting wheel 11. Each of the manifolds 48, 49, 50 extend through an arc of about 90° along the interior of casting wheel 11 starting near the presser wheel 14*a*, thence along the lower portion of the casting wheel, and extending up towards the tension wheel 14*d*. Thus these manifolds 48–50 supply coolant to three successive groups, or zones, of spray nozzles 51.

Similarly, the band manifolds 40, 41, 42 are positioned along an arcuate path adjacent to the band 12 starting near the presser wheel 14*a* and extending in a downward direction around the lower portion of the casting wheel up to a point near the tension wheel 14*d*.

A pair of wheel side manifolds 45 is positioned on opposite sides of the arcuate mold and extend from about the entrnace of the mold down toward the bottom portion of the casting wheel 11 while another pair of side manifolds 46 extend from the bottom of the casting wheel 11 up towards the exit of the mold.

Thus it should be apparent that these various manifolds, each of which supply coolant to groups of spraying nozzles 51, allow the precise control of the cooling rate of the cast bar within the moving mold.

In addition the present invention utilizes a coolant manifold (discussed below) inside of the presser wheel 14*a* to allow precise cooling of the molten metal pool during its critical early stages of solidification.

As shown in FIG. 1, the liquid coolant, such as water, is supplied to the manifolds of casting machine 10 by means of main supply pipe 52. A plurality of branch conduits extend from the main supply pipe 52 and communicate with the various manifolds as follows: branch conduit 54 supplies coolant to the presser wheel 14*a*, conduit 55 supplies coolant to the upper band manifold 40, conduit 56 supplies coolant to the lower band manifold 41 and conduit 57 supplies coolant to the remaining rear band manifold 42. Branch conduit 58 supplies coolant to the front pair of side manifolds 45 while conduit 60 supplies coolant to the rear pair of side manifolds 46. Each of the aforementioned branch conduits includes a control valve which functions to regulate the pressure and thus the flow of coolant from main supply pipe 52 to the various manifolds. Branch conduit 62 extends from the main supply pipe 52 and is connected to valve assembly 64 of the casting wheel manifolds 48–50. Valve assembly 64 includes three control valves 65, 66, 67 which function to control the flow of coolant from branch conduit 62 into each of the interior wheel manifolds 48, 49, 50 respectively.

Preferably a main control value 70 is positioned in main supply pipe 52 and is electrically or pneumatically actuated so as to initiate the flow of coolant into the branch conduits when casting is begun.

Figure 2:
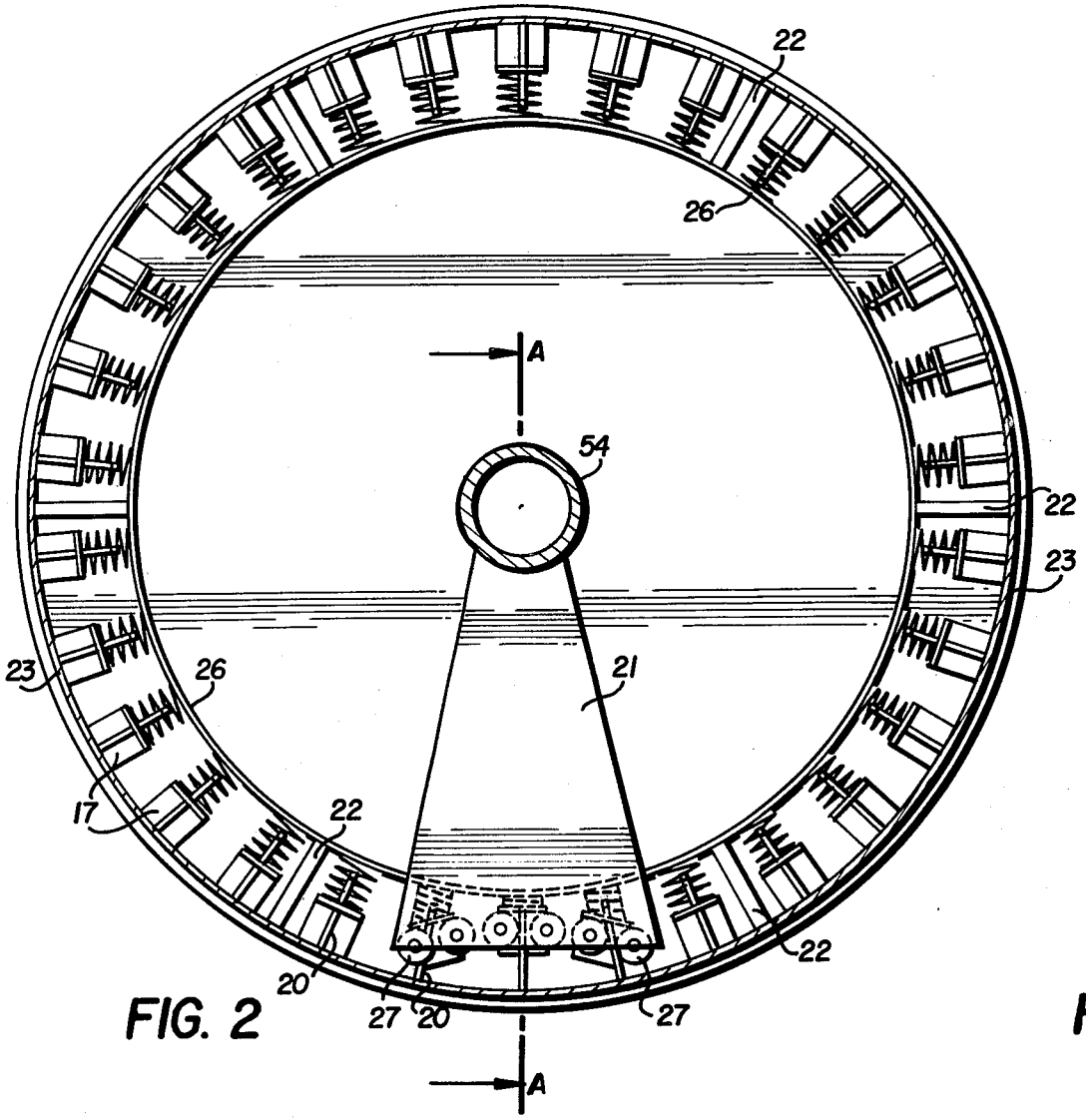
FIG. 2 is a side view of the presser wheel apparatus (front plate removed) showing the location of the inner mechanisms, e.g., the roller assembly and spring assemblies and their related supports.

Turning now to FIG. 2, the preferred embodiment of the present invention is shown in more detail. Presser wheel 14*a* comprises an outer peripheral surface 23, adapted to support the metalic band 12 as it is guided around the wheel, and an inner annular ring 26, adapted to support the numerous coolant metering mechanisms. The inner ring 26 is spaced apart from the outer surface 23 by numerous ring supports 22 spaced at intervals about the circumference of wheel 14*a*.

Figure 4:
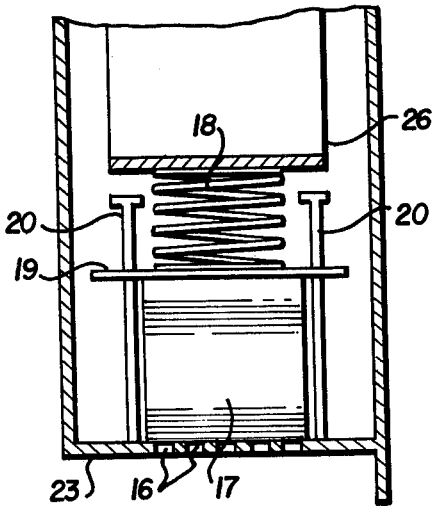
FIG. 4 is a partial cross sectional view of FIG. 2 taken in a horizontal plane.
Figure 3:
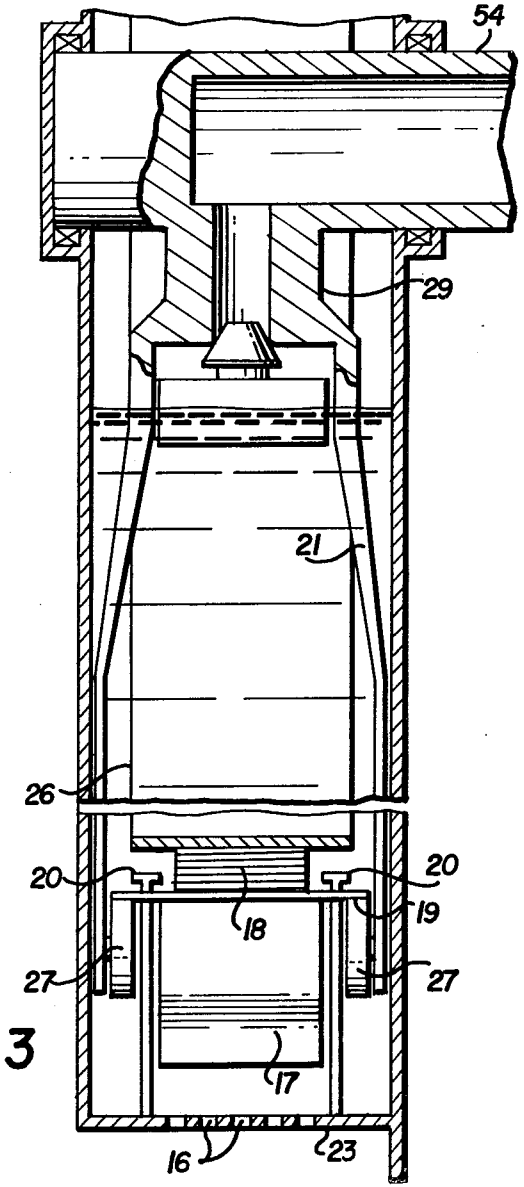

The coolant metering mechanisms each comprise a resiliant block 17 having a metal backing plate 19 bonded to one surface and a spring 18 between the backing plate 19 and the inner ring 26 as shown more clearly in FIGS. 3 and 4. FIGS. 3 and 4 also show that the outer surface 23 of the presser wheel 14*a* has a plurality of rows of holes or ports 16 with the rows being spaced at regular intervals. The width of the presser wheel 14*a* is wide enough to cover the belt 12 associated with the casting machine 10. The rows of ports 16 are normally sealed on the inside by a neopreme block 17 or other suitable resilient material. FIG. 4 shows this sealing block 17 has a metal backing plate 19 which is wider than block 17 and has circular openings in each end such that a guide rod 20 may pass through each opening, holding the sealing block 17 in position over the spray ports 16. The sealing block 17 is forced down over the ports 16 by a spring 18 supported from the rear by inner ring 26.

A roller support arm 21, as depicted in FIGS. 2 and 3 is connected to the fixed shaft at the center of the wheel 14*a* and supports a fixed set of rollers 27 that are suspended between the outer face of the wheel and the inner ring 26. The rollers 27 are arranged in an arcuate fashion opposite to the curvature of the wheel as indicated by the drawing. Thus, as the wheel 14*a* rotates relative to the rollers, the sealing blocks 17 are raised (as shown in FIG. 3) by the rollers 27 lifting against their metal backing plate 19, allowing coolant from within the wheel to pass through the now uncovered ports 16. After the backing plate 19 passes over the rollers 27 it returns the sealing block 17 to its former position (as shown in FIG. 4), due to the restoring force of the spring 18, guided by the seal guide rods 20 that pass through the backing plate 19.

The coolant is preferably contained within the interior of the wheel 14*a* at a level below the axel shaft. This coolant is transferred to the wheel through a hollow stationary pipe 29 which communicates with branch conduit 54. The wheel turns on bearings (not shown) around the shaft and a water-tight seal may be maintained between the stationary shaft and rotating wheel to prevent the coolant from escaping or reaching the bearings. The wheel itself may have a permanently fixed back plate but the front plate should be removable so that adjustments can be made to the springs or sealing blocks and general maintenance performed as necessary. Also, this front plate should preferably have a seal around its edges to prevent coolant from leaking from within the wheel.

EXAMPLE I

A molten 6201 aluminum alloy, at a temperature of about 1270° F., is supplied to casting machine 10, which is a 96 inch diameter casting wheel 11 and a peripheral groove of 5 square inches, at a rate of about 19,000 pounds per hour.

The casting machine cooling system is adjusted according to the teachings of the art so that a cast bar, exiting the system at a speed of about 53 feed per minute, has a temperature of about 850° F.

The supplemental cooling system of the present invention, i.e. a small amount of water flowing against the casting bond opposite the point of first molten metal contact, is then adjusted to about 5 to 15 psi water pressure. The cast bar temperature is found to be increased by about 50° F. (i.e. to about 900° F.).

An examination of the cast bar 30 produced by this improved process is found to have substantially less inverse segregation on the band-side surface as compared to a prior art cast bar (i.e. one produced without coolant supplied to the presser wheel, similar to the method disclosed in U.S. Pat. No. 3,613,767). In addition, observation of the subsequent hot rolling process shows that there is a decrease in band-side cracks after the first deformation thereof. This is thought to be due to the improved microstructure obtained by the supplemental cooling of the present invention.

This embodiment is, of course, merely exemplary of the possible changes or variations. Because many varying and different embodiments may be made within the scope of the inventive concept disclosed herein and because many modifications may be made in the embodiment herein detailed in accordance with the descriptive requirements of the law, it should be generally understood that the details herein are to be interpreted as illustrative and not in a limiting sense.

What is claimed is:

1. In a continuous metal casting machine of the type having an arcuate mold cavity formed by a peripheral groove in a rotatable casting wheel and an endless metallic band which seals a portion of said groove, and having multiple band support wheels, one of which is tangent to the casting wheel at the entrance to the mold and functions to press the band against said casting wheel, the improvement comprising:

conduit means for supplying a flow of coolant to the interior of said one of band support wheels; sealable passageways, in the periphery of said support wheel, which communicate with the interior of said support wheel; movable means for sealing said passageways; and means for moving said sealing means thereby unsealing said passageways and allowing coolant to flow from the interior of said support wheel to and through the periphery of said support wheel and thence onto the band and wherein said movable means for sealing said passageways further comprises:

a resilient block adapted to sealingly cover said passageways, spring means for urging said block to cover said passageways, and lifting means attached to said block for moving the block against the urging of the spring means so as to uncover said passageways.

2. The apparatus of claim 1 further including means for guiding said block durings its movement from the covering position to the uncovering position.

3. An improved apparatus for continuously and uniformly cooling a solidifying molten metal pool in an arcuate mold of the type formed by a peripheral groove in a rotatable casting wheel and an endless metallic band which is pressed against said casting wheel by a band presser wheel located at the entrance of said mold and which band seals a portion of said groove so as to form one side of said arcuate mold, wherein the improvement comprises:

coolant applicator means located within the band presser wheel, means for supplying coolant to said coolant applicator means and means for adjusting the rate of flow of said coolant from said applicator means to the metal band whereby the cooling rate of the molten metal pool may be accurately controlled during the first critical stages of solidification and wherein said coolant applicator means comprises:

a plurality of pores spaced at regular intervals about the periphery of said band presser wheel, and wherein said coolant flow rate adjusting means comprises sealing devices that are periodically raised and lowered so as to cover and uncover said pores, thus regulating the flow of said coolant onto said band.

4. The Apparatus of claim 3 wherein said sealing devices include a resilient block adapted to sealingly cover said pores, spring means for urging said block to cover said pores, and lifting means attached to said block for moving the block against the urging of the spring means so as to uncover some of said pores thereby allowing said coolant to flow through the uncovered pores.

5. The apparatus of claim 4 further including means for guiding said block during its movements.

* * * * *